US009316461B1

(12) United States Patent
Gwillim, Jr.

(10) Patent No.: US 9,316,461 B1
(45) Date of Patent: Apr. 19, 2016

(54) GUN SIGHT USING LED ILLUMINATION

(71) Applicant: Reese C. Gwillim, Jr., Boulder Creek, CA (US)

(72) Inventor: Reese C. Gwillim, Jr., Boulder Creek, CA (US)

( * ) Notice: Subject to any disclaimer, the term of this patent is extended or adjusted under 35 U.S.C. 154(b) by 0 days.

(21) Appl. No.: 14/498,906

(22) Filed: Sep. 26, 2014

(51) Int. Cl.
*F41G 1/34* (2006.01)

(52) U.S. Cl.
CPC ..... *F41G 1/345* (2013.01)

(58) Field of Classification Search
CPC ..... F41G 1/345; F41G 1/027; F41G 1/06; F41G 1/02; F41G 1/473; F41G 11/003; F41G 11/001; F41G 1/16; G02B 23/105; G02B 27/0101; B29D 11/00634; B29D 11/00865; G01J 1/0411; G01J 5/04; H04N 5/23293; H04N 5/232
USPC ..... 42/111, 132, 133, 144, 145
See application file for complete search history.

(56) References Cited

U.S. PATENT DOCUMENTS 2,822,616 A * 2/1958 Gangl ..... F41G 1/32 42/145
3,994,072 A * 11/1976 Agnello, Jr. ..... F41G 1/345 42/132
5,735,070 A * 4/1998 Vasquez ..... F41G 1/345 42/1.02
6,571,504 B2 * 6/2003 Carlson ..... F41G 1/345 42/132
7,627,976 B1 * 12/2009 Olson ..... F41G 1/345 42/132
8,387,294 B2 * 3/2013 Bolden ..... F41C 27/00 42/1.01
8,444,291 B2 * 5/2013 Swan ..... A42B 3/044 362/190
8,607,495 B2 * 12/2013 Moore ..... F41G 1/35 42/114
2006/0026886 A1 * 2/2006 Doukas ..... F41C 33/0254 42/117

OTHER PUBLICATIONS

Website printout: "Tritium Sights for Pistols", http://chris.cc/tritium.htm, 2001, 2 pages.

* cited by examiner

*Primary Examiner* — Troy Chambers
*Assistant Examiner* — Bridget Cochran
(74) *Attorney, Agent, or Firm* — Thomas Schneck; David Schneck

(57) ABSTRACT

A gun sight system including a housing, comprised of a top housing layer and a bottom housing layer. The housing includes a front end and a rear end configured to adhere to the front and rear of the top surface of a gun slide. A central portion of the housing is configured to be perpendicular to the front top and rear top sections. Within the housing is a front and rear circuit board, including at least one battery mount, at least one switch, and a front LED and a rear LED. The housing has a window to allow light from the LED to shine into a window on a front and rear gun sight. A light pipe within each gun sight allows the light to be seen by the gun's user.

7 Claims, 5 Drawing Sheets

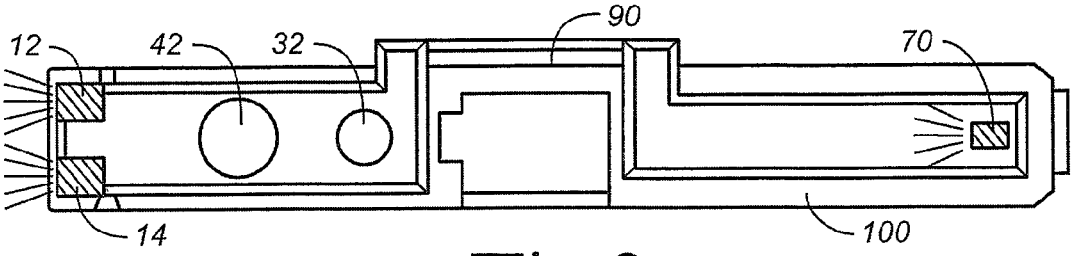
Fig. 3
Fig. 4
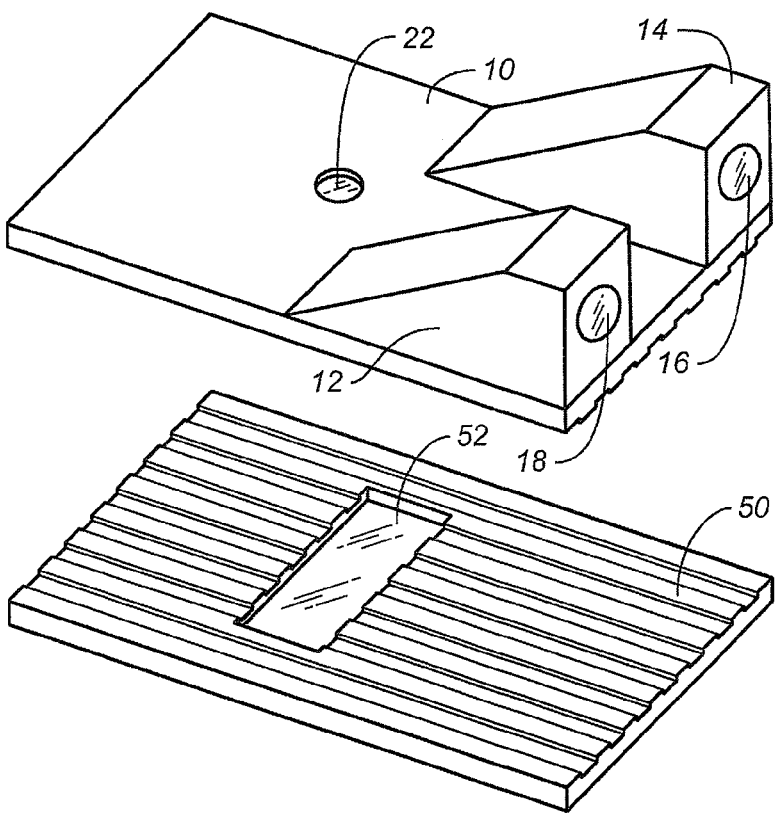

GUN SIGHT USING LED ILLUMINATION

TECHNICAL FIELD

The present invention relates to devices to be used on a firearm and more specifically to a device providing an illuminated gun sight to allow use of the sight during low or variable lighting conditions.

BACKGROUND ART

Gun sights are used on firearms to aid in aiming the firearm. Properly trained gun owners (including military and law enforcement) will use the sights to aim the weapon. Given that a handgun may be used in a life threatening situations, the weapon's user has very little time to aim the weapon at a target. However proper aim is critical to minimize potential injury to bystanders and to ensure that the target threat is neutralized.

A standard handgun sight includes a single, raised front sight centered at the top, front surface of the gun barrel or gun slide. The front sight is a single raised projection. The rear sight is an elongate projection with a central notch at the rear of the gun. The central notch of the rear sight is centered on the barrel or slide of the gun. To aim the gun, the target is aligned with the front sight, when the front sight is aligned with the notch of the rear sight.

Additional difficulty is encountered in low or variable lighting conditions when the front and rear sights are more difficult to see. One widely adopted solution to this problem is to use tritium sights. The front and rear sights of the handgun are modified to include space for a clear vial visible to a user firing the weapon. The inside of this clear vial is a coating of phosphor or other gas that may be excited by radioactive emissions from the radioactive tritium gas. The resulting glow is visible to the user, allowing the sights to be used in lower light conditions (e.g. dark interiors or nighttime).

There are a number of known drawbacks to the use of tritium or other radioactive gasses in this application of use in a gun sight. Any radioactive compound will have a characteristic decay. Tritium has a half-life of 14 years, meaning that after 14 years half of the tritium will have decayed into helium. In addition, the phosphorescent coating also may be subject to degradation over time, could be subject to photo bleaching, or other factors which degrade its efficacy. A gun sight will begin to decay once manufactured. It is difficult to tell the age of the tritium, and used guns or older sights are difficult to evaluate. A user is faced with a continually degrading light source, which is not ideal. Ideally, the light source would be consistent, eliminating a variable during the stressful conditions of firearm use. In addition, these tritium gun sights are going to emit light at a single brightness.

The phosphorescent compounds currently used in gun sights emit at a variety of different wavelengths, allowing selection of different colors to be observed by a user. Human visual perception makes green and yellow preferred colors for use in this application. Commonly a first color is used on the front sight and a second color is used on two vials in the rear sight that flank the notch in the rear sight. This makes centering the front sight in the notch easier, and reduces the changes of misalignment of the front sight to the left or right side of the rear sights (rather than between the rear sights). In addition, the size of the phosphorescent windows can be varied between the front and rear sights to aid in alignment.

In addition to degradation of luminescent sights, installation of sights can also be a concern with this technology. Generally, the sights that are available in the standard manufactured weapon are not luminescent. When tritium sights are installed, generally vertical and horizontal adjustment are required to make sure that the current sights are useful for achieving true aim.

Horizontal adjustment requires that the old sights be removed from the guns and that the new rear sights are installed in a dove tail mounting and adjusted to ensure that the sight is properly centered such that the gun will aim true. The average shooter or consumer can't easily or carefully take off stock sights (or what are called "iron sights") alone. Once a consumer obtains "Night Sights" the consumer generally will have the new sights installed by either a gun smith or other professional that owns a tool called a "Sight Pusher". A sight pusher is a heavy metal handheld device that locks on to a slide (that has been removed from the handgun). A screw device on the sight pusher tool is used to push the old sight out of the dove tail mounting, removing the old sight from the slide of the gun. The new sights are then placed in the start of the dovetail and the sight pusher, using the same screw device, pushes the new sight in to place.

The device still must be horizontally adjusted to aim true. This generally requires that the gun owner takes the gun to a gun range (with the new sight mounted on the gun), and, with the aid of a sight pusher, move the rear sight left or right as needed. In some instances a professional at a gun range (or the gun owner) can use a brass punch and hammer to incrementally move the rear sight left or right to the desired location. This method can also be used to take off iron sights. However this is not an easy process and requires some skill to avoid damaging the firearm or the sight. Sight pushers cost can range from a low of about $50 dollars to over $200 dollars. Since most people don't own a sight pusher and are reluctant to use a brass punch and hammer on their new sights they usually bring their shot at targets from the range back to the gunsmith. Looking at the used targets coupled with the known distance (say 25 yards) it was shot at, a gunsmith can ballpark estimate about how far he needs to move the rear sights left and right to compensate for each shooters needs. Again, more time and energy being expended on the installation and set up of the new sights.

Vertical adjustment requires shaving the sights down. This is generally done by an experienced gunsmith and like horizontal adjustment requires specialized tooling. Alternatively, a gunsmith could install fluorescent vials in existing sights on a gun by drilling out stock sights and placing fluorescent vials in the bored holes.

One object of the disclosed embodiments is to provide a gun sight system that allows use at night using an improved technology.

SUMMARY DISCLOSURE

One embodiment of the invention is a gun sight device usable during low light conditions. The device is mounted on a gun slide, and can be mounted by a user without professional installation. The device includes a substrate, such as a printed circuit board, that forms a continuous strip stretching from the rear of the slide to the front of the slide. On the front and rear of the slide, the substrate is configured to attach to the top surface of the slide. Between the front and rear of the substrate is a substantially perpendicular central portion of the substrate. In this instance, "substantially perpendicular" means conforming to the shape and position of the side of a gun slide relative to the top surface of the gun slide. While for some guns this may be a few degrees off from perfectly perpendicular, the substrate will be as perpendicular as the relationship of a top of a gun slide to the side of the gun slide.

On the bottom of the substrate is an adhesive (which may include a release liner for ease of installation) which allows the substrate to be secured to the gun slide.

On the substrate is a battery terminal, which allows a battery power source to be mounted on the substrate. This provides power to elements on the substrate. Such elements include a front LED and rear LED, each connected by a conductive trace on the substrate to the battery. A switch on the substrate is interposed between the battery terminal and the front and rear LEDs. This allows the LEDs to be turned on and off, either automatically (for example, through use of a reed switch on a holster to automatically turn on the sight illumination when the gun is drawn), or manually by a user (for example, when the gun is in use or when lighting conditions make use of illuminated sights preferred by a user). Light pipes on the substrates convey the light from LEDs to the front and rear sights, which are also mounted on the substrates. A cover may be secured on the substrate, effectively encasing the LEDs, and battery terminal, while allowing the switch to the actuated.

The rear assembly will, in one embodiment, be molded as one complete unit of the portion that slides into the dovetail. In one embodiment two nylon locking nuts are used imbedded into the thickest part of the dovetail plastic. These two nuts are the two points where the rear sights will screw into the fixed rear assembly.

A potentiometer connected between said battery terminal and the front and rear LEDs may be included in some embodiments to allow dimming of the front and rear LEDs. In one embodiment the potentiometer is used in connection with a light meter, also mounted on the substrate. The potentiometer is configured to increase LED brightness during greater light readings and decrease LED brightness during lower light readings. In this manner a user is presented with a more consistent perception the brightness of the LEDs.

In one embodiment, the potentiometer will probably only be used once to set the baseline minimum amount of light the sights will ever be activated at (worse case lighting scenario). This will be to address age and vision strengths and weakness in individual shooters. After the potentiometer is set by the end user it probably won't be reset again and the amount of light the sights emit will be dictated by the amount of ambient light a photoelectric cell detects. The LED will need to be less bright during low ambient light shooting conditions and brighter during brighter ambient light conditions. In one embodiment, the photoelectric cell will be located to the rear of the slide to better give a realistic reading of ambient light. If the photodetector was placed toward the front sight it will tend to give a false reading and due to the front portion of the slide is always covered in the dark portion of the holster.

In an additional embodiment, the front LED and the rear LED can produce light of different colors. For example, the front LED could be green, and the rear LED could be yellow. By centering the single front LED between the flanking two rear LEDs, the user can make sure that the gun is properly aimed.

The above gun sight system makes apparent a related method for modification of a gun sight system to add illuminated sights. The stock sights are removed, which may require a professional gun smith. However the installation of the new sights may be done by the gun owner. A substrate is secured (e.g. by adhesive) to the slide of a handgun. The front and rear sections of this substrate adhere to the top of the slide, while a contiguous, perpendicular bridge adheres to the side of the gun slide. A front and rear sight (e.g. LED illuminated sights) are secured onto the slide via the substrate. A window in the sights allow illumination from the LEDs to be seen by the user during low light conditions. In one embodiment, the LEDs are of different colors.

BRIEF DESCRIPTION OF THE DRAWINGS

FIG. 3 is a top view of the gun slide of FIG. 2 having an assembled illuminated sight system.

FIG. 4 is a top perspective view of a rear sight installation components.

DETAILED DESCRIPTION

Figure 1:
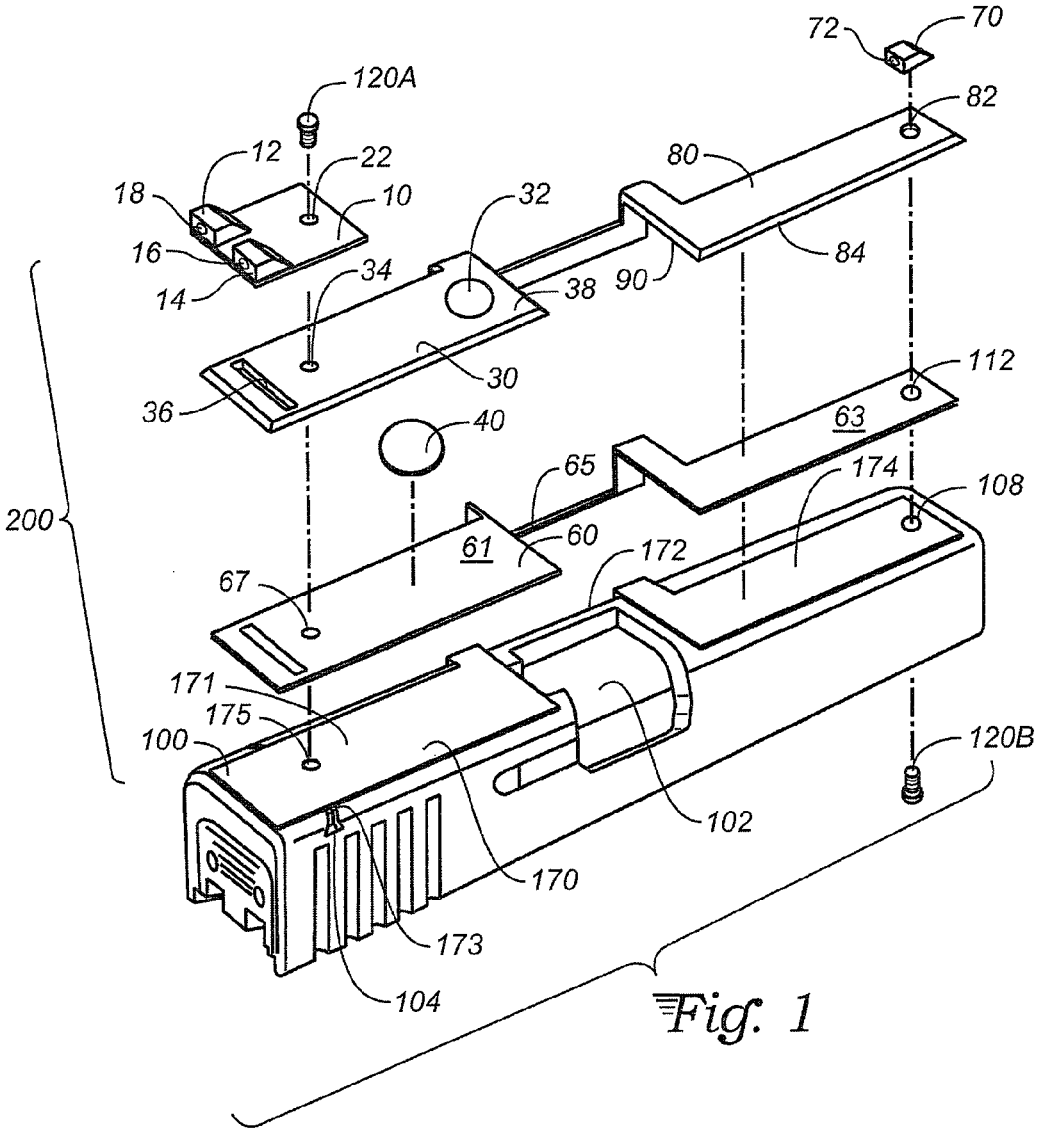
FIG. 1 is an exploded view of a gun slide and an LED illuminated sight system.

With reference to FIG. 1, an exploded view of an embodiment of the invention shows a gun slide 100. This slide is the type that may be used on a Glock® brand automatic handgun. The slide includes a central opening 102 through which shell casings are ejected after firing. A dove tail mounting slot 104 allows mounting of the stock rear sight. The stock front sight is attached using a screw 120B, through front sight mounting hole 108.

The illustrated embodiment includes a bottom housing 170 and a top housing 30 which are joined together to encase a printed circuit board 60. A detail view of the printed circuit board is shown at FIG. 1C. The bottom housing 170 and top housing 30 may be made of high impact plastic. Bottom housing 170 has a underside adhesive 176. This may be an adhesive that includes a release liner adhering to the adhesive layer. The release liner could be removed and the device mounted on a gun. The adhesive would then cure, providing a firm attachment to the gun slide. This could be done by the gun owner. The bottom housing includes a front section 174 and a rear section 171 that adhere to the top of the gun slide. A perpendicular bridge section 172 attaches to the side of the slide at the location of the central opening 102. This can aid in proper placement of the sight device. Two additional features also ensure proper placement. The first is a dove tail mount 173 that slides into the dove tail mounting slot 104 on the slide. The second is hole 108 through which a screw 120B is secured. These two features attach the sight system to the front and rear of the slide.

Above bottom housing 170 is the printed circuit board 60. Above printed circuit board 60 is top housing 30. These three layers are joined together to form a single sealed part. This protects the electronics inside the housing. The top housing 30 in one embodiment has an opening to allow a user to change the battery in the device.

Figure 1A:
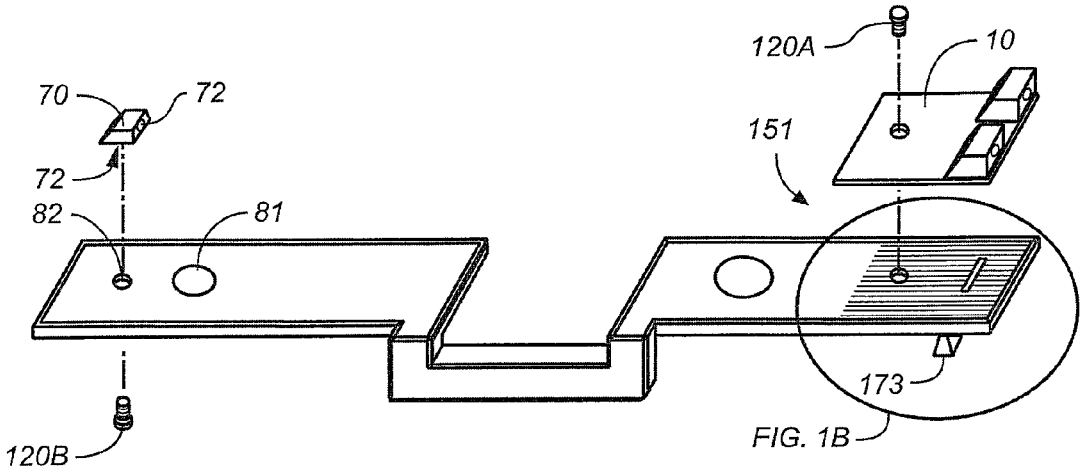
FIG. 1A is a top perspective view of an illuminated sight as assembled.
Figure 1B:
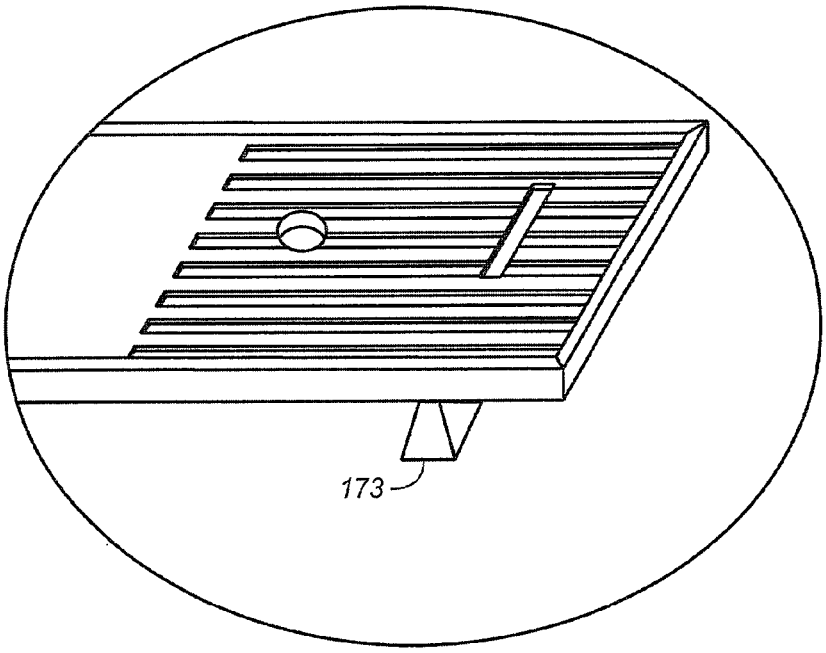
FIG. 1B is a detail view of the rear housing showing the dovetail mounting.
Figure 1C:
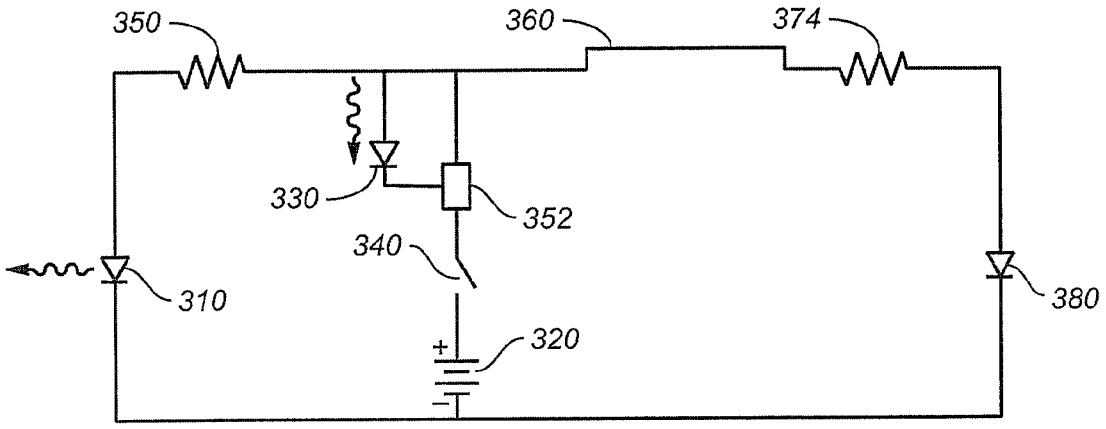
FIG. 1C is a circuit diagram of the printed circuit board.

In this disclosed embodiment, the sight is intended to be provided to the user in three parts as shown in FIG. 1A. The first part is the high impact plastic housing top and bottom part 151. The top and bottom sections are secured together (e.g. by sonically welding, adhesive, other attachment means). This will sandwich and shield the front and rear PCB's, LED's and the bridge wires connecting the two halves together. This first part 151 will be mounted to the top of the slide with the bridge housing mounted just slightly below the top of the slide on the left hand side. The rear portion will be held in place by sliding the dove tail mounting 173 into the existing dovetail mounting slot that is used to mount conventional rear sights. Dove tail mounting 173 is shown in greater detail in FIG. 1B. The front portion will be held in place by the existing screw 120B that is secured from inside (underside) of the slide and screws into the bottom of the front sight 70 thorough hole 82. A window 81 allows light from the LED to pass into light pipe 72 on front sight 70. In one embodiment, about half of the device will treated with a commercial grade adhesive to affix the device to the slide in the areas between the rear dovetail and the front mounting screw and the plastic housing that carries the bridge wires on the left side of the slide. Rear sight 10 is secured to the first part 151 by screw 120A.

In one embodiment, to make the device as water repellent as possible there will only be one opening, probably in the rear of first part 151 (comprised of the parts in FIG. 1 indicated by bracket 200). From there the end user will be able to replace the battery. The battery may be a lithium ion battery of appropriate voltage. In one embodiment the rear section houses the photoelectric eye used to detect ambient light conditions and to house any secondary activation switch (reed, RFID, accelerometer etc). A switch to detect removal of the weapon from the holster, if used, in one embodiment will be mounted towards the front of the slide. This is the area where the weapon and holster are consistently kept in close proximity to each other which would decrease false activations.

Returning to FIG. 1, as noted the bottom housing 170 and the top housing 30 enclose printed circuit board 60, which in the illustrated embodiment includes front circuit board 63 and rear circuit board 61, joined by wire 65. Rear printed circuit board 61 includes a battery mount for mounting battery 40. A hole 112 on front printed circuit board 63 allows the screw 120B to pass through the printed circuit board. The screw is then attached to front sight 70.

The top housing section 30 includes a front section 84, a rear section 38 and a perpendicular middle bridge section 90. This conforms to the shape of the bottom housing section 170, allowing the two sections to be secured together to form a single unitary structure. Hole 82 allows the front sight 70 having a light pipe 72 to be secured using screw 120B. The rear sight 10 has a hole 22 through which screw 120A is secured. The screw is secured through hole 22 in the rear sight, hole 34 in the top housing, hole 67 in the rear PCB and into threaded receptacle 175 on the lower housing. Rear sight 10 includes a left rear sight 12 having a light pipe 18 and a right rear sight 14 having a light pipe 16. Top housing section also has an actuator button 32 to allow the LEDs to be turned on and off and a clear, acrylic window 36 which allows light from the rear LED mounted on the circuit board to reach the rear sights 12, 14 and be seen by the user through light pipers 16, 18.

In one embodiment, the front assembly will be primarily held in place by the adhesive. When that is in place and secured, the front stand-alone sight will be placed over it and will be held in place by the screw coming up from the inside of the slide (like existing front sights are mounted conventionally.

Figure 1D:
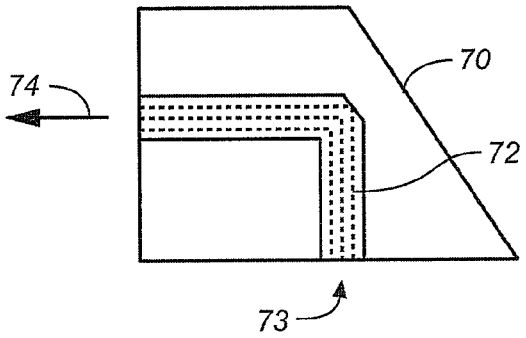
FIG. 1D is a cross section of the front sight.

FIG. 1D shows a cross section of the front sight 70. A light pipe 72 internal to the front sight 70 is used to transmit light from the LED below the sight to the window on the viewable face of the sight. Light enters at arrow 73, and is seen by the user as indicated by arrow 74.

FIG. 1C shows a circuit diagram 300 of the front and rear circuit boards described in FIG. 1A. Rear circuit board 302 and front circuit board 372 are connected by wire or wire bus 360. A battery 320 mounted on a battery mount on the circuit board 302 provides a power source for both the rear LED 310 and the front LED 380. Resistors 350 and 374 limit current flow from the battery to the LEDs. A switch 340 can be actuated by a user or automatically actuated (as by use of a Reed switch explained in relation to the other figures). A photo sensitive diode 330 is included in some embodiments as an "electronic eye" or light meter, to regulate LED brightness automatically. This element is positioned near a window in the housing, as explained in relation to FIG. 1A. A potentiometer 352 may also be included to allow setting of LED brightness by a user based on user preference.

Figure 2:
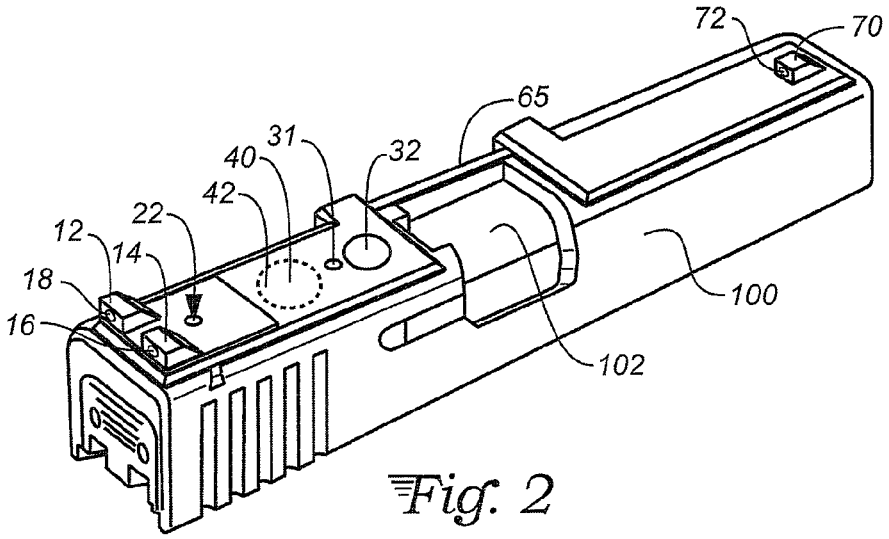
FIG. 2 is top perspective view of the gun slide of FIG. 1 having an assembled illuminated sight system.

With reference to FIG. 2, the slide 100 is shown having central opening 102. The rear sights 12 and 14 have light pipes 18, 16 which provide the illumination at night. A hole 22 allows a screw (not shown in this view) to secure this rear sight to the housing. Front sight 70 having light pipe 72 is also secured by a screw, as shown in the other figures. An electric eye 31 allows detection of ambient light, and automatic setting of LED brightness for the lit sights. A dimmer switch 32 allows manual adjustment of brightness of the LEDs in some embodiments. An actuator switch 42 overlaying battery 40 allows the device to be turned on and off. This is molded into the plastic housing.

With reference to FIG. 3, the slide 100 is shown with the sighting device mounted on the slide 100. The front sight 70 has a first associated color. In some embodiments, this is a different color than the color of the rear sights 12, 14. This makes it easier for a user to line up the sights without having the front sight be outside of the rear sights. Green and yellow may be preferred because these colors are easier to see under low light conditions. The edge of the device has a slight angle all around the device (such as a 45 degree angle) to ensure that the edge does not catch on a holster. The device is activated using button 42 and the brightness controlled with dimmer switch 32. The bridge structure 90 is perpendicular to the front and rear sections. This section encases wires or other means to bring power from the rear section to the front section.

With reference to FIG. 4, the rear sight 10 is shown using a plate 50 to adjust vertical height of the sight. Windows 52 and 54 on the height adjustment plate 50 allow light from the PCB to reach the windows 18 and 16 in rear sights 12 and 14. The grooves 51 on the top of plate 50 match to grooves on the bottom of rear sight 10. This will ensure that the sights are true and parallel to the front sight and not askew. Plate 50 and rear sight 10 interlock.

Figure 5:
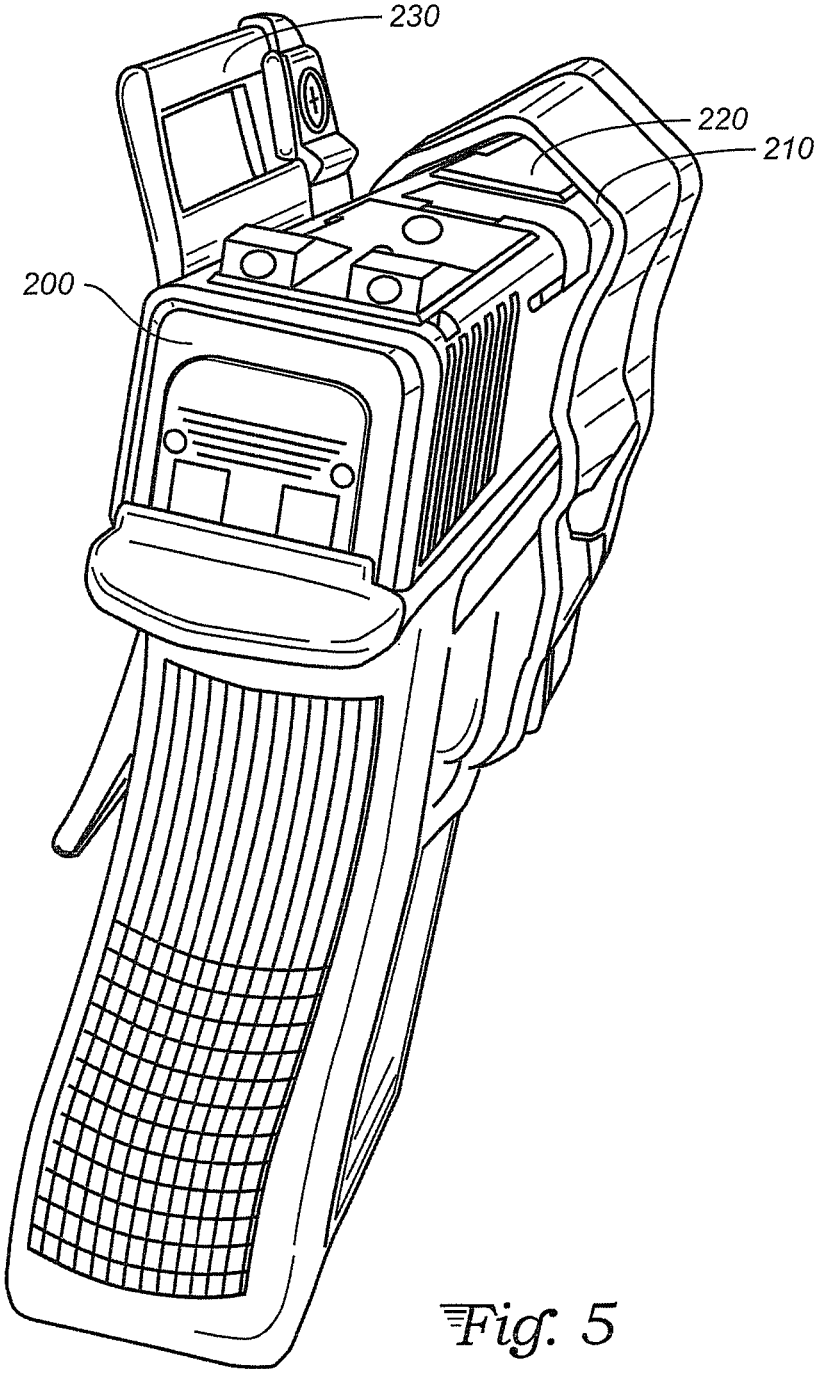
FIG. 5 is a rear perspective view of an automatic handgun and holster.

With reference to FIG. 5, a gun 200 is shown in a holster 250. A loop 230 allows attachment onto a belt. A magnet 210 is included on the holster. A magnetic sensor 220 on the illuminated sight allows the sight to automatically turn on when a user draws the gun from the holster. This can conserve battery for the LEDs.

What is claimed is:

1. A gun sight device comprising: a substrate shaped in a continuous strip to have a front end portion and a back end portion that conform to a shape of a top surface of a gun slide and a central portion at a location along a slide of a central slide opening, said central portion substantially perpendicular to said front end portion and back end portion such that said central portion conforms to a shape of a side surface of a gun slide; a groove received mounting on the back end portion of the slide fit into a rear slide groove on said slide; an adhesive on a bottom surface of said substrate; a battery terminal on said substrate for connecting to a battery; a front LED on said substrate in electrical connection to said battery terminal; a rear LED on said substrate in electrical connection to said battery terminal; a switch on said substrate, interposed between said battery terminal and said front LED and said rear LED, allowing power from said battery connected to said battery terminal to be turned on and off; a front sight mounted on said substrate; a front light pipe positioned to channel light from said front LED to a front window in said front sight; a rear sight mounted on said substrate; and a rear light pipe positioned to channel light from said rear LED to a pair of rear windows on said rear sight, wherein said rear sight has a plurality of underside parallel grooves that mate with a plurality of topside grooves on said substrate, aligning said rear sight.

2. The gun sight of claim 1, further comprising a cover secured over said substrate.

3. The gun sight of claim 1, further comprising a potentiometer connected between said battery terminal and said front LED and said rear LED.

4. The gun sight of claim 3, wherein said potentiometer is connected to a light meter mounted on said substrate and configured to increase LED brightness during greater light readings and decrease LED brightness during lower light readings.

5. The gun sight of claim 1, wherein said front LED produces light of a first color and the rear LED produces light of a second color.

6. The gun sight of claim 1, wherein said switch on said substrate is actuated by withdrawing a gun from a holster.

7. The gun sight of claim 6, wherein said switch is a reed switch.

* * * * *